United States Patent [19]

Lee et al.

[11] Patent Number: 4,505,697

[45] Date of Patent: Mar. 19, 1985

[54] UNDERFLOW CONCENTRATION CONTROL FOR NOZZLE CENTRIFUGES

[75] Inventors: Chie-Ying Lee, Pleasant Valley; James D. West; Gerald F. Cole, both of Poughkeepsie, all of N.Y.

[73] Assignee: Alfa-Laval, Inc., Poughkeepsie, N.Y.

[21] Appl. No.: 605,080

[22] Filed: Apr. 30, 1984

[51] Int. Cl.[3] ..... B04B 7/00

[52] U.S. Cl. ..... 494/35; 494/37

[58] Field of Search ..... 494/35, 36, 37, 22, 494/23, 27, 42, 85, 10

[56] References Cited

U.S. PATENT DOCUMENTS

| | | | |
|---|---|---|---|
| 2,223,999 | 12/1940 | Miller | 494/37 |
| 2,779,536 | 1/1957 | Pomeroy | 494/35 |
| 3,204,868 | 9/1965 | Honeychurch | 494/35 |
| 3,799,431 | 3/1974 | Lavanchy | 494/35 |
| 4,162,760 | 7/1979 | Hill | 494/10 |

*Primary Examiner*—Robert W. Jenkins
*Attorney, Agent, or Firm*—Cyrus S. Hapgood

[57] ABSTRACT

In a centrifuge for the separation of solids from liquid in which concentrated solids are discharged from radial nozzles at the rotor periphery, there is a need for control of the solids concentration by controlling the recycle of solids to the centrifuge. The present invention provides a flow path divided into small cross-sectional areas, as with parallel plates, for the flow of recycled solids therethrough, at an appropriate pressure drop and flow rate to cause a strong dependence on fluid viscosity. A small receiving tank, with a fixed or adjustable weir, is attached to the inlet of the sectional flow path to provide a constant pressure drop through the device by maintaining a volume of concentrated solids at a preselected height above the inlet. The cross-sectional area available for flow is manually adjustable by means of a blocking plate at the inlet of the sectioned flow path.

21 Claims, 8 Drawing Figures

UNDERFLOW CONCENTRATION CONTROL FOR NOZZLE CENTRIFUGES

This invention relates to the control of centrifugal separators of the type having a return path for recycling to the separator inlet a part of the underflow of concentrated solids discharged from one outlet, the other outlet discharging a clarified liquid. More particularly, the invention relates to a novel method and apparatus for controlling the concentration of solids in the underflow.

BACKGROUND OF THE INVENTION

In centrifugal separators of the above-noted type, known as nozzle centrifuges, the separated underflow is discharged through nozzle means arranged at the outer periphery of the separating chamber in the centrifugal bowl. In the use of such centrifuges, it is often necessary to control the solids content of the discharging underflow by recycling part of it to the centrifuge inlet. The most common application of underflow recycling is in cases where the feed to the centrifuge has a low content of solids, and the desired result is a high concentration of solids in the underflow. The need for adequate control in these cases is defined by two extremes in which the control is inadequate or non-existent, namely, (1) the underflow contains too much feed liquid or (2) it contains too high a concentration of solids so as to cause plugging of the discharge nozzles.

It is general knowledge in the art that for most liquids an increase in suspended solids results in an increased viscosity of the liquid. Consequently, an ideal way to control the solids content of the underflow would be to monitor and control the viscosity of the underflow.

Many systems have been proposed for controlling the solid content of a centrifuge underflow. However, these prior systems are quite insensitive to changes in the viscosity of the underflow. Viscosity is defined as the ratio of shear stress to shear rate. More simply, viscosity is the inherent property of a liquid to resist deformation from shear. For liquid flow, viscosity can be measured as a change in velocity of a moving liquid due to an applied shear force. For example, the shear stress exerted at the wall of a pipe on a liquid flowing through it results in a net loss in velocity of the liquid. Since stress is a measurement of force per unit area, an increase in shear area will result in an increase in shear stress created within the liquid. In the above example, an increase in pipe length will increase the shear area with a net loss in liquid velocity for a constant pressure drop.

Most systems for control of recycled underflow have relied upon valves and/or orifices. These have been used as flow restrictions in various combinations in the underflow return path, in the flow stream of the non-returned part of the underflow (reject) or a combination of both streams.

The problem with using a conventional valve or orifice to control underflow concentration lies in the fact that these flow restrictors are typically insensitive to viscosity. The pressure drop across a valve or orifice is a function of the velocity and viscosity of the liquid flowing therethrough. Since the length of the valve or orifice in the direction of the liquid flow is small, the ratio of shear area to cross-sectional area of the valve opening or orifice is small. There is a minimal shear area, therefore, in the valve or orifice, which means that that the pressure drop across it is primarily a function of velocity. Viscosity has only a small effect on pressure drop, so that viscosity changes have only a minimal effect on the pressure drop. Since mass flow through typical valves and orifices is primarily a function of pressure drop, those devices are not suited for controlling the centrifuge underflow. In fact, most of the pressure drop due to viscosity in prior recycle systems is due to the connecting pipework and not the valves or orifices.

An example of a system for controlling the underflow from nozzle centrifuges is disclosed in U.S. Pat. No. 4,162,760 issued to Hill in 1979. That prior system uses an adjustable head sump for recycling with an adjustable toroidal ring-type valve. Because of its limited shear area, the valve is no more viscosity-sensitive than a needle valve. As the valve is opened to allow the desired flow therethrough, the ratio of its shear area to its cross-sectional flow area is drastically decreased, resulting in loss of sensitivity to viscosity and viscosity changes. There is no way in which the sensitivity to viscosity can remain constant for selected changes in recycle solids concentration or recycle rate with this type of arrangement.

As the underflow solids content increases, the point at which the centrifuge will plug is approached. Therefore, it is desirable to have the greatest sensitivity to viscosity, and hence to solids content at the higher solids concentrations. However, the converse is true with the arrangement in U.S. Pat. No. 4,162,760. In order to increase the solids concentration in the underflow, the toroidal ring must be opened to allow a greater volume of thickened solids to recycle through the centrifuge. As the ring is opened, the ratio of shear area to cross-sectional flow area is reduced, thereby reducing the sensitivity to viscosity and ultimately to underflow solids concentration. Thus, the point at which the need for sensitivity to viscosity is the most critical is the point at which the arrangement in U.S. Pat. No. 4,162,760 is the lease sensitive to viscosity.

SUMMARY OF THE INVENTION

According to the present invention, part of the centrifuge underflow is recycled to the centrifuge by way of duct means having a cross-sectional area open to flow and a shear area, the latter being the area contacted by the underflow as defined by the walls of the duct means. The ratio of the shear area to the cross-sectional flow area of the duct means is sufficiently high to cause a substantial reduction in the flow rate through the duct means in response to an increase in the viscosity of the underflow. More particularly, underflow containing a given concentration of solids will exhibit a certain viscosity as it flows through the duct means, and with constant viscosity and constant pressure head on the underflow entering the duct means, the flow therethrough will be at a fixed rate. As the solids content increases, the resulting increased viscosity of the underflow causes it to flow at a reduced rate through the duct means, thus reducing the amount of underflow recycled through the centrifuge and counteracting the increase in viscosity. Of course, the reverse will be true for a decrease in the solids content of the underflow. In this way, the concentration of solids in the underflow discharging from the centrifuge can be held substantially constant.

In the preferred practice of the invention, means are provided for adjusting the cross-sectional flow area of the duct means while maintaining its ratio of shear area to flow area constant. In this way, the solids concentration at which the underflow is held substantially constant can be adjusted while maintaining the same high sensitivity of the duct means to viscosity changes. Also the duct means may be replaceable by other duct means having a different said ratio than the replaced duct means, so as to adapt the control to a liquid-solids mixture having substantially different properties than the original mixture.

Preferably, the duct means comprise a plurality of passages through which respective divisions of the underflow pass as it returns to the centrifuge, and means are provided for changing the number of these passages operable to conduct divisions of the underflow. In this way, the solids concentration at which the underflow is held substantially constant can be increased or decreased without affecting the sensitivity of the duct means to viscosity changes.

For adequate control of the solids concentration in most cases, the duct means should have a ratio of shear area to cross-sectional flow area which is at least 50 to 1.

BRIEF DESCRIPTION OF DRAWINGS

For a better understanding of the invention, reference may be made to the accompanying drawings in which.

MORE DETAILED DESCRIPTION OF THE INVENTION

Figure 1:
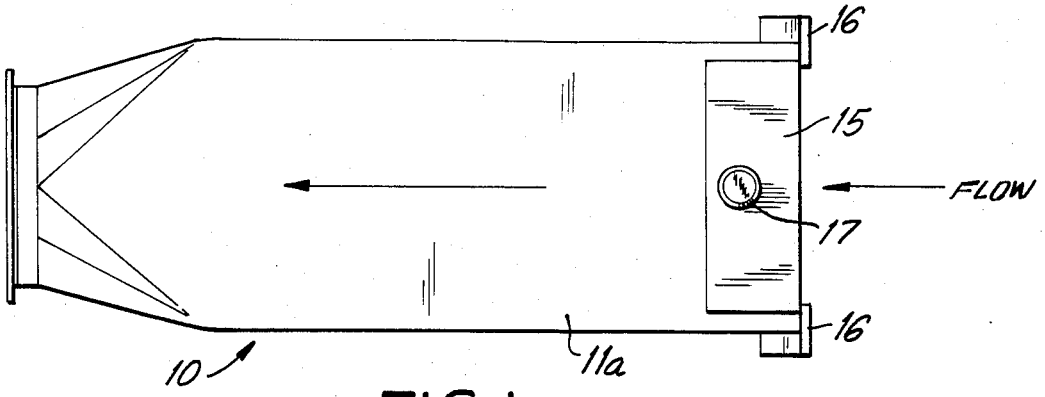
FIG. 1 is a plan view of a preferred form of duct means through which part of the underflow passes on its way back to the centrifuge.
Figure 2:
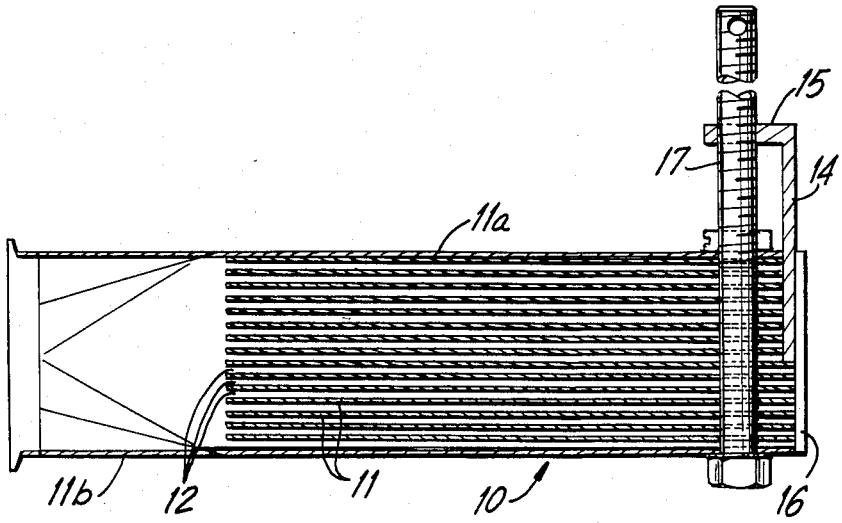
FIGS. 2 and 3 are a vertical sectional view and a front end view, respectively, of the duct means in FIG. 1.
Figure 3:
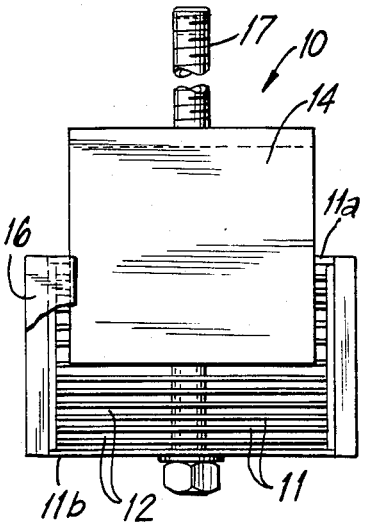

Referring to FIGS. 1–3, the duct means 10 there shown comprises a bundle of plates 11 held by spacers (not shown) in parallel spaced relation to define a series of flow passages 12 between the plates. Passages 12 are open at their opposite ends but are otherwise closed by side walls which, together with the top and bottom plates 11*a* and 11*b*, form a housing for the other plates. As shown in FIGS. 1 and 2, the underflow enters the housing at its right-hand end and is then divided into a number of divisions which flow separately through a plurality of the elongated passages 12. These divisions are then re-combined before discharging from the plate housing at its left-hand end.

An adjustable blocking plate 14 is located between the inlet ends of passages 12 and guide members 16 at opposite edge portions of the blocking plate (FIGS. 1 and 2). Plate 14 has a horizontal flange 15 through which a threaded vertical shaft 17 extends; and by rotating this shaft the plate 14 may be raised to increase the number of passages 12 operable to conduct divisions of the underflow, or lowered to reduce the number of such passages. Thus, the adjustable blocking plate 14 constitutes a means for increasing or decreasing the total cross-sectional flow area of the duct means 10 without changing the ratio of the total shear area to the total said flow area of the duct means.

Figure 4:
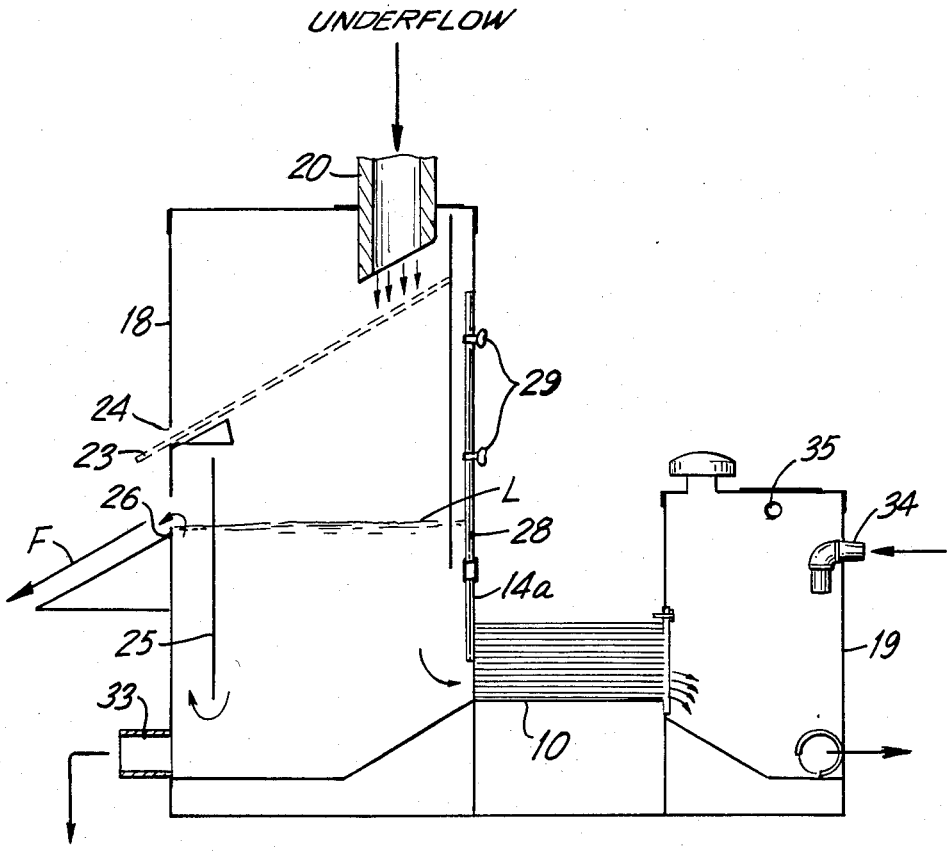
FIG. 4 is a schematic view of the duct means of FIGS. 1–3 combined with other parts of the preferred control apparatus.
Figure 5:
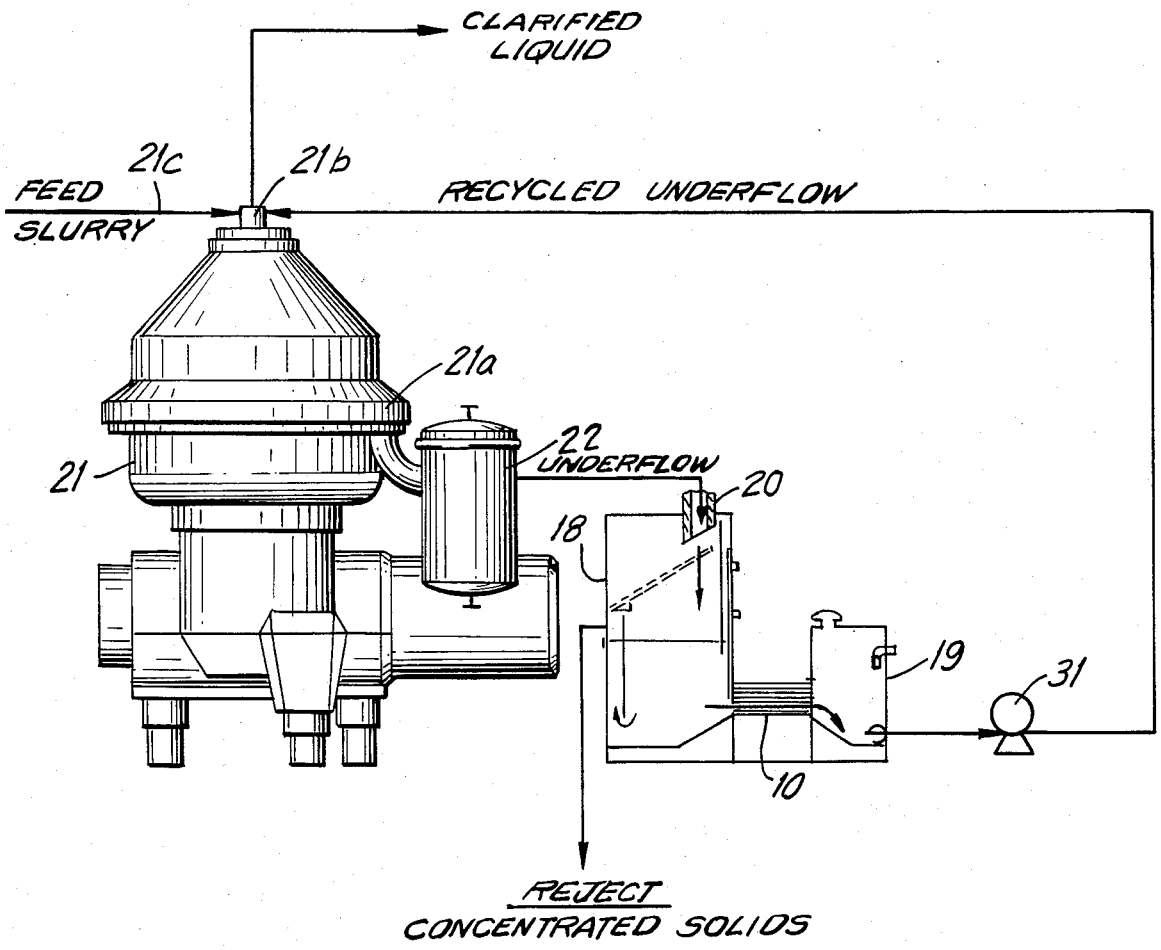
FIG. 5 is a schematic view of the combination in FIG. 4 applied to a centrifuge of a preferred type.

As shown in FIGS. 4 and 5, duct means 10 is connected at its inlet end to a constant head tank 18 and at its outlet end to a recycle collection tank 19. At its upper portion the tank 18 has an inlet 20 for receiving underflow from the nozzles of the centrifugal separator 21 by way of an underflow feed tank 22. For some materials which may dry in the discharge cover 21*a* of centrifuge 21, a slanting run-off screen 23 is mounted in tank 18 below its inlet 20 and screens out large dry solids in the underflow. These large solids are discharged by gravity through a side outlet 24 of tank 18. Underflow which does not pass through duct means 10 flows under a baffle 25 in tank 18 and over a weir plate 26, from which it is removed as the reject stream F.

Since the weir 26 keeps the underflow at a constant level L in tank 18, a constant pressure head is maintained on the underflow entering the duct means 10. Of course, the weir may be adjustable vertically to vary this pressure head.

In FIG. 4, blocking plate 14*a* is shown connected to a rod 28 which is adjustable vertically to vary the number of unblocked flow passages in duct means 10. The rod is held in its adjusted position by suitable clamps 29.

Underflow with concentrated solids flowing through duct means 10 enters recycle tank 19 and is pumped back to centrifuge 21 by external pump 31 (FIG. 5). This pump may be arranged to operate automatically whenever the centrifuge drive motor is operating.

As shown in FIG. 4, tank 18 may be cleaned through bottom outlet 33 having a shut-off valve or removable plug (not shown). Pipe 34 leading into collection tank 19 provides a means for adding a flushing solvent to dilute the solids in the recycle underflow during centrifuge shut-down. Clarified liquid from centrifuge outlet 21*b* (FIG. 5) can be diverted to the recycle underflow through inlet 35 of tank 19 during centrifuge shut-down. This diversion of clarified liquid creates a closed loop system on shut-down, which ensures flooding of the centrifuge bowl at all times.

Centrifuge 21 (FIG. 5) is of the well-known type in which the separating chamber of the centrifugal bowl (not shown) contains a stack of conical discs between which solids are centrifugally separated from liquid of the feed mixture as the liquid flows radially inward to discharge through the clarified liquid outlet 21*b*. The separated solids pass to the outer periphery of the separating chamber, from which they are discharged with residual liquid through the previously mentioned nozzles. The recycled part of this underflow from the nozzles is combined with the feed slurry fed to the centrifuge inlet, as shown at 21*c*. Details of how the combined slurry and recycled underflow enter the separating chamber of the centrifugal bowl, and how the clarified liquid and the underflow discharge from this chamber through their respective outlets, will be readily apparent to those skilled in the art.

Once the desired underflow solids concentration is chosen by adjustment of blocking plate 14 or 14*a*, any changes in the solids content or feed rate of the slurry fed at 21C are automatically counteracted by the control apparatus. For example, if the solids in the feed stream enter the centrifuge inlet at an increased rate, there will be a net increase in the solids concentration in the underflow. The resulting increase in the underflow's viscosity causes a reduced velocity of flow through duct means 10 and therefore a reduced rate at which solids enter the centrifuge by way of the recycled underflow. On the other hand, if the solids content or feed rate of the feed slurry is reduced, the resulting decrease in underflow viscosity causes an increase in the flow rate through duct means 10 and in the rate at which solids are recycled with the underflow. Thus, with a fixed pressure drop (from head tank 18) and a fixed cross-sectional flow area of duct means 10, the underflow can be controlled at a set viscosity. Moreover, the magnitude of the set viscosity can be readily adjusted by simply raising or lowering the blocking plate to increase or decrease the cross-sectional flow area of the duct means. It will be apparent that raising this plate will increase the set viscosity (and the solids concentration maintained in the underflow) and vice versa.

A major advantage of the control apparatus is that its high sensitivity to viscosity changes does not vary with adjustment of the blocking plate to select a desired solids concentration to be maintained in the underflow. That is, the walls of each passage 12 of the duct means provide a shear area which is a high multiple of the passage's cross-sectional flow area, and this relationship continues regardless of the number of passages which are unblocked by the blocking plate.

Laboratory tests indicate that a preferred ratio of shear area to cross-sectional flow area for most feed mixtures is approximately 60:1. Substantially higher ratios mean reducing the total flow through the duct means and thus reducing the maximum solids concentration which can be maintained with the higher viscosity sensitivity resulting from the higher ratios. However, laboratory experiments were performed using ratios of 75:1, 100:1 and 150:1; and with a constant head pressure of 6 to 12 inches at the inlet of the duct means, this range of ratios proved highly successful for controlling the underflow solids concentration of the feed material tested.

Figure 6:
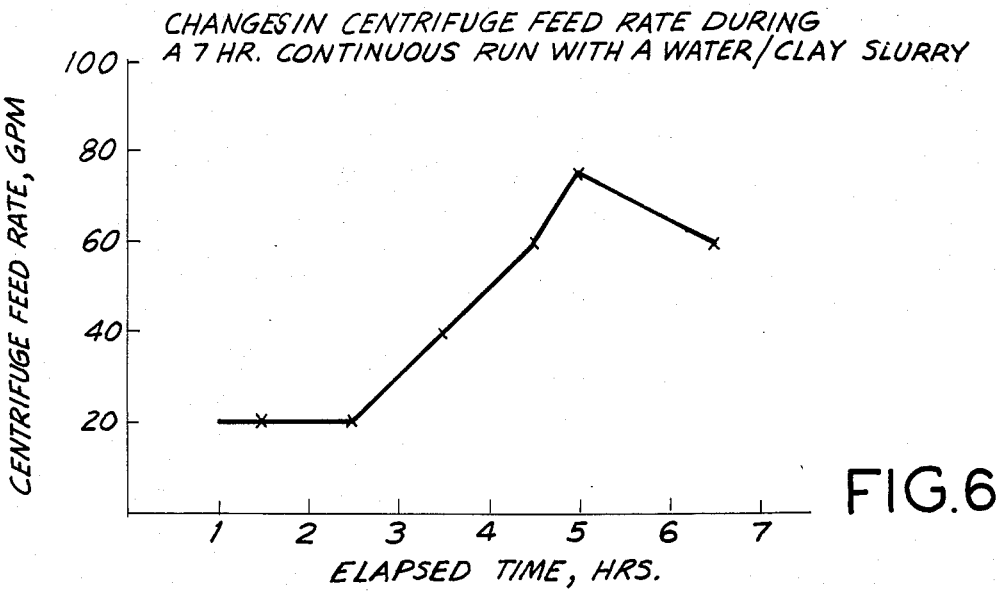
FIGS. 6–8 are graphs depicting data from an experimental run of a centrifuge with apparatus made according to the invention for controlling the solids concentration in the underflow.
Figure 7:
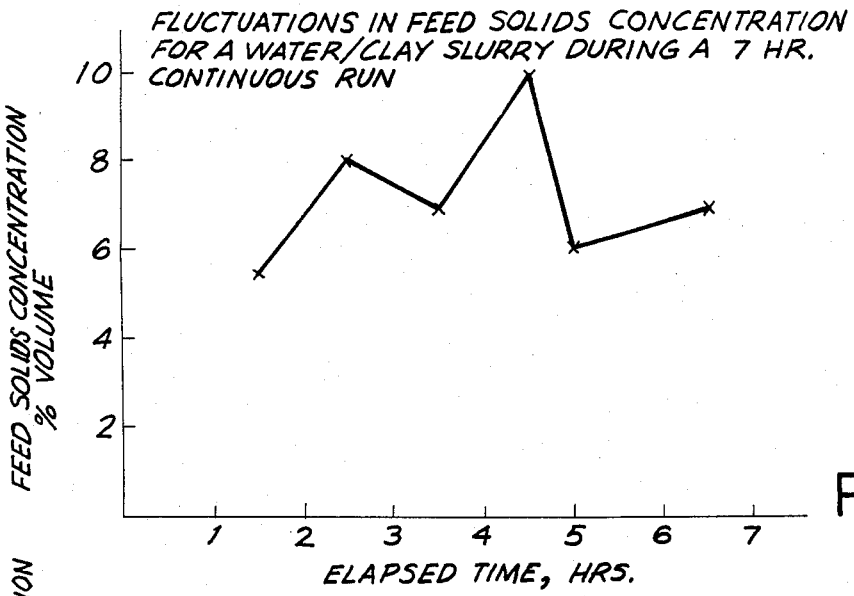
Figure 8:
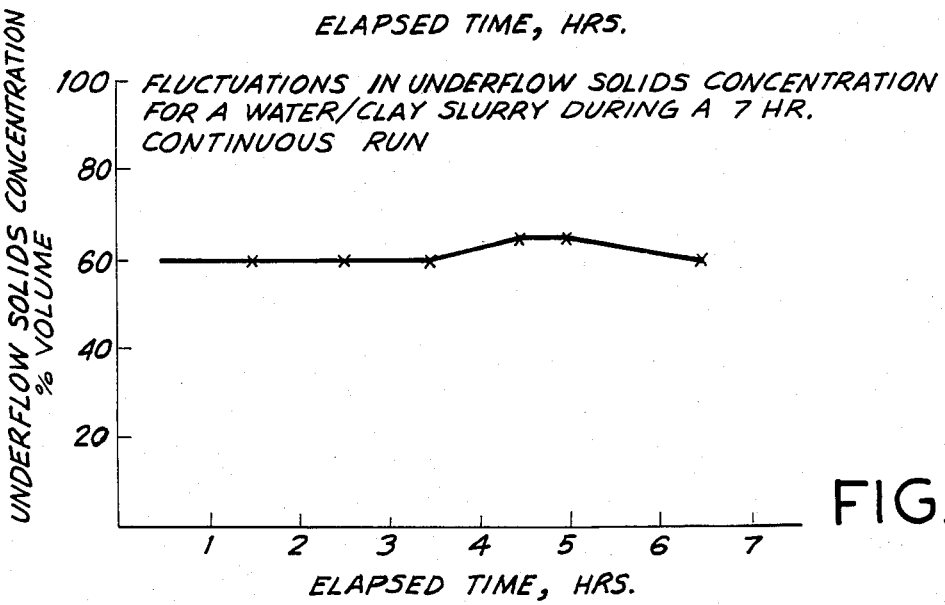

The three graphs in FIGS. 6–8 depict the data obtained from a single seven-hour experimental run using a water-clay slurry. The test system was similar to that shown in FIG. 5, and the ratio of total shear area to total cross-sectional flow area of duct means 10 was 100:1. The best ratio for this particular slurry would probably be between 100:1 and 150:1. During the seven-hour run, the feed rate ranged from 20 GPM to 75 GPM, representing nearly a fourfold increase. The feed solids varied from 5.5 to 10.0%, representing a doubling of the solids loading by solids concentration alone. Nevertheless, as shown in FIG. 8, the net change in underflow solids concentration during the seven-hour period was less than 10%.

The number of interplate passages 12 that are needed depends upon the spacing between adjacent plates. The smaller the spacing the greater the number of passages needed to achieve the desired underflow consistency. The number of passages 12 open to flow in the seven-hour experimental run was four. The total number of passages in the duct means was fourteen, ten of these passages having been blocked off. The number of open passages 12 needed for the desired underflow consistency is determined by trial and error. Initially, a "best guess" number of spaces are opened while the system is running. To thicken the underflow, the number of open passages is increased, and vice versa.

The duct means 10 may be removable so that it can be replaced by another duct means having a different ratio of shear area to cross-sectional flow area. In this way, the control apparatus can be adapted to different feed mixtures which differ greatly in their fluid properties and in the viscosity range which would be the critical control range.

It will be understood that the duct means 10 can take many other forms than that illustrated. For example, the cross-sections of its flow passages can be round, eliptical or any other desired shape. In fact, it would be possible to practice the invention with only a single flow passage in the duct means, provided that it has a high ratio as previously described and its cross-sectional flow area can be changed without changing the high ratio.

We claim:

1. In the operation of a centrifugal separator having an inlet for a liquid and solids mixture and a first outlet for clarified liquid, the separator also having a second outlet for an underflow of solids concentrated in residual liquid, the method of controlling the concentration of solids in the underflow, said method comprising the steps of discharging underflow from said second outlet into a return line while operating the separator, continuously flowing underflow through said line while dividing the underflow into a plurality of divisions, passing said divisions through respective passages each having a cross-sectional flow area and a shear area, the ratio of said shear area to said flow area being sufficiently high to substantially reduce the flow rate through said passages in response to an increase in the viscosity of the underflow, and returning the underflow from said passages to said inlet of the separator.

2. The method of claim 1, which comprises also increasing the number of said divisions and passages while maintaining said ratio constant, thereby increasing the rate of underflow return to said inlet so as to increase the solids content of the underflow discharging from said second outlet.

3. The method of claim 1, which comprises also replacing said passages with other passages having a different said ratio than the replaced passages, said different ratio accommodating a different said mixture.

4. The method of claim 1, which comprises also maintaining a substantially constant pressure head on the underflow entering said passages.

5. In combination with a centrifugal separator having an inlet for a mixture of liquid and solids and also having a first outlet for clarified liquid and a second outlet for an underflow of solids concentrated in residual liquid, and a return line for recycling part of said underflow from said second outlet to said inlet, apparatus in said return line for controlling the concentration of solids in said underflow and comprising duct means forming a plurality of passages for conducting flows of respective divisions of the underflow, each flow-conducting passage having a cross-sectional flow area and a shear area, the ratio of said shear area to said flow area being sufficiently high to cause a substantial reduction in the flow rate through said passages to the separator inlet in response to an increase in the viscosity of the underflow.

6. The combination of claim 5, in which said apparatus comprises also means for varying the total cross-sectional flow area of said duct means while maintaining substantially constant said ratio for each flow-conducting passage.

7. The combination of claim 6, in which said varying means are adjustable to vary the number of said passages operable to conduct flow of the underflow.

8. The combination of claim 5, in which said apparatus comprises also means in said return path for maintaining a substantially constant pressure head on the underflow entering each of said passages.

9. The combination of claim 5, in which said apparatus comprises also a tank having at its upper portion an inlet for receiving underflow from said second outlet, said passages leading from a lower portion of the tank, the tank also having means for maintaining the underflow therein at a substantially constant level above said passages.

10. The combination of claim 9, in which the tank also has an outlet for diverting part of the underflow from said return path.

11. The combination of claim 5, in which said apparatus comprises also a tank having at its upper portion an inlet for receiving underflow from said second outlet, said passages leading from a lower portion of the tank, the tank also having an outlet for diverting part of the underflow from said return path, said tank outlet being formed by a weir which maintains the underflow in the tank at a substantially constant level above said passages.

12. The combination of claim 11, comprising also a screen interposed between said tank & inlet and said level in the tank, said screen being operable to prevent an agglomeration of bulk solids from entering said passages.

13. The combination of claim 5, comprising also means in said return path located upstream from said passages and operable to remove from said path an agglomeration of bulk solids discharged from said second outlet.

14. The combination of claim 5, in which said apparatus comprises also a recycle tank for receiving underflow from said passages, said return path including a conduit leading from the recycle tank to said inlet of the separator.

15. The combination of claim 14, comprising also a pump in said conduit.

16. The combination of claim 5, in which said duct means include a series of parallel plates spaced from each other to define a said passage between each pair of adjacent plates.

17. The combination of claim 16, comprising also blocking means associated with said plates and adjustable to vary the number of said passages operable to conduct flow of said underflow.

18. The combination of claim 16, comprising also a blocking member located at the inlet ends of said passages, and means for adjusting said member transversely of said passages to selectively block and unblock at least one of said passages.

19. The combination of claim 5, in which said duct means are replaceable to provide passages having a different said ratio.

20. The combination of claim 5, in which said ratio is at least 50 to 1.

21. In combination with a centrifugal separator having an inlet for a mixture of liquid and solids and also having a first outlet for clarified liquid and a second outlet for an underflow of solids concentrated in residual liquid, apparatus for controlling the concentration of solids in said underflow, said apparatus comprising duct means connecting said second outlet to said inlet and through which part of the underflow is recycled to said inlet, said duct means having a cross-sectional flow area and a shear area, the ratio of said shear area to said flow area being sufficiently high to cause a substantial reduction in the flow rate through said duct means in response to an increase in the viscosity of the underflow, and means for changing said cross-sectional flow area while maintaining said ratio constant.

* * * * *